US012486839B2

(12) United States Patent
Gerber, Jr. et al.

(10) Patent No.: US 12,486,839 B2
(45) Date of Patent: Dec. 2, 2025

(54) VALVE CONDITION MONITORING SYSTEM FOR A POSITIVE DISPLACEMENT PUMP

(71) Applicant: Schlumberger Technology Corporation, Sugar Land, TX (US)

(72) Inventors: David Gerard Gerber, Jr., Sugar Land, TX (US); Muharrem Ali Tunc, Sugar Land, TX (US); Kevin L. Case, Sugar Land, TX (US); Caroline Shipley, Lake Charles, LA (US); Han Yu, Sugar Land, TX (US); Jagan Thaduri, Sugar Land, TX (US); Seoyeon Hong, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 96 days.

(21) Appl. No.: 18/548,662

(22) PCT Filed: Feb. 24, 2022

(86) PCT No.: PCT/US2022/017687
§ 371 (c)(1),
(2) Date: Sep. 1, 2023

(87) PCT Pub. No.: WO2022/187072
PCT Pub. Date: Sep. 9, 2022

(65) Prior Publication Data

US 2024/0141886 A1 May 2, 2024

Related U.S. Application Data

(60) Provisional application No. 63/155,448, filed on Mar. 2, 2021.

(51) Int. Cl.
*F04B 51/00* (2006.01)
*F04B 49/06* (2006.01)

(52) U.S. Cl.
CPC ..... *F04B 51/00* (2013.01); *F04B 49/065* (2013.01); *F04B 2205/02* (2013.01); *F04B 2205/04* (2013.01)

(58) Field of Classification Search
CPC .. F04B 51/00; F04B 2205/02; F04B 2205/04; F04B 49/065
See application file for complete search history.

(56) References Cited

U.S. PATENT DOCUMENTS 5,772,403 A * 6/1998 Allison ..... F04B 49/065 417/44.2
6,882,960 B2 * 4/2005 Miller ..... F04B 51/00 702/182

(Continued)

FOREIGN PATENT DOCUMENTS

WO 9736106 A1 10/1997
WO WO-2010136746 A1 * 12/2010 ..... E21B 21/06
WO WO-2018044289 A1 * 3/2018 ..... F04B 53/10

OTHER PUBLICATIONS

Search Report and Written Opinion of International Patent Application No. PCT/US2022/017687 dated Jun. 7, 2022, 11 pages.

(Continued)

*Primary Examiner* — Nathan C Zollinger
(74) *Attorney, Agent, or Firm* — Jeffrey D. Frantz

(57) ABSTRACT

A technique for monitoring valve and pump efficiencies for positive displacement pumps. The techniques include utilizing a data acquisition system to attain intake and discharge pressure data in combination with real-time encoder position data. Thus, when combined, output from a pump may be monitored in real-time. As a result, pump life may be extended beyond an anticipated changeout schedule. By the same token, premature pump inefficiencies may also be detected for taking a pump offline in advance of expected (Continued)

life. In either circumstance, multi-pump operations may be substantially enhanced with cost and time savings realized.

20 Claims, 6 Drawing Sheets

(56) References Cited

U.S. PATENT DOCUMENTS

| | | | | |
|---|---|---|---|---|
| 9,797,395 | B2 * | 10/2017 | Urdaneta | F04B 9/045 |
| 10,480,296 | B2 * | 11/2019 | Beisel | E21B 43/12 |
| 11,125,225 | B2 * | 9/2021 | Beisel | F04B 9/045 |
| 2004/0167735 | A1 * | 8/2004 | Rothman | G01F 1/712 702/100 |
| 2004/0213677 | A1 * | 10/2004 | Matzner | F04B 51/00 417/63 |
| 2010/0300683 | A1 * | 12/2010 | Looper | E21B 47/008 166/250.01 |
| 2013/0233165 | A1 * | 9/2013 | Matzner | F01B 25/04 91/1 |
| 2013/0280106 | A1 | 10/2013 | Kyllingstad | |
| 2016/0208794 | A1 * | 7/2016 | Singh | F04B 51/00 |
| 2017/0082101 | A1 * | 3/2017 | Urdaneta | F04B 1/00 |
| 2018/0202423 | A1 * | 7/2018 | Zhang | F04B 51/00 |
| 2019/0271305 | A1 * | 9/2019 | Beisel | F04B 9/045 |
| 2019/0316592 | A1 | 10/2019 | Jenkins | |
| 2021/0198992 | A1 * | 7/2021 | Christinzio | E21B 43/26 |

OTHER PUBLICATIONS

International Preliminary Report on Patentability of International Patent Application No. PCT/US2022/017687 dated Sep. 14, 2023, 8 pages.

Substantive Exam issued in Saudi Arabia patent Application No. 523450502 dated Mar. 28, 2024, 10 pages with English translation.

* cited by examiner

VALVE CONDITION MONITORING SYSTEM FOR A POSITIVE DISPLACEMENT PUMP

PRIORITY CLAIM/CROSS REFERENCE TO RELATED APPLICATION(S)

This Patent Document is a national stage entry under 35 U.S.C. 371 of International Application No. PCT/US2022/017687, filed on Feb. 24, 2022, entitled "VALVE CONDITION MONITORING SYSTEM", which claims priority under 35 U.S.C. § 119 to U.S. Provisional App. Ser. No. 63/155,448, filed on Mar. 2, 2021, entitled "Valve Condition Prognostication Techniques", which is incorporated herein by reference in its entirety.

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and horizontal architecture may increase the likelihood of accessing underground hydrocarbons, other challenges are presented in terms of well management and the maximization of hydrocarbon recovery from such wells. For example, as is often the case with vertical wells, stimulation operations may take place to encourage production from lateral or horizontal regions of the well. This may be done in a zone by zone fashion with perforating applications followed by fracturing applications to form fractures deep into targeted regions of a formation.

A fracturing application may be directed from an oilfield surface where a host of positive displacement pumps are used to drive fracturing fluid downhole at high pressure for sake of stimulation. By way of example, for a given well, ten to twenty different frac trucks may be arranged near a wellhead at surface. Each frac truck may include a triplex, quintiplex or other high pressure positive displacement pump that is used to take in and drive high pressure fracturing fluid through a common line and into the well through the wellhead. The fluid will include a mix of water, proppant, such as sand, and other various constituents tailored to the application and well characteristics. This fluid mixture may be combined at the surface and supplied to each pump for the fracturing application.

The driving of the fracturing fluid mixture through the combined efforts of the pumps may supply a large volume of fluid downhole at pressures exceeding 5-15,000 PSI or more. Keeping in mind that this abrasive, often chemically laden, fluid is being driven through a pump with moving parts, accounting for the possibility of wear induced pump inefficiencies, is often of critical concern. For example, it would not be uncommon for all of the pumps at a given site to operate for several hours continuously. Further, the application process may repeat several times over the course of several days. During this time an internal plunger is reciprocated as intake and discharge valves are sequentially opened and closed at a valve seat. Thus, for every closure of a valve seal at a valve seat, the potential for high impact sandwiching of proppant and debris occurs. For this reason alone, the polymeric seal is prone to wear, cracking and other forms of deterioration. Of course, frac fluid chemical constituents and repeated high impact valve closure itself may also play roles in valve seal deterioration.

Regardless of the reason, valve seal deterioration may have a significant impact on the efficiency or continued use of a given pump. That is, where a valve fails to sufficiently seal during closure, the effectiveness of the reciprocating plunger on a chamber that takes in and discharges frac fluid is compromised. This is because pressure in the chamber is no longer tightly governed by the reciprocating plunger. Seal deterioration may also lead to repeated metal to metal striking of valves on valve seats where the seal has deteriorated. Indeed, in many circumstances, it is the metal to metal striking that actually leads to valve interface damage which in turn compromises sealing. Once more, given the frac fluid abrasiveness, this metal to metal striking may also lead to catastrophic pump damage where the actual hardware of the valve region is permanently damaged.

Further magnifying the problem is the fact that each pump chamber includes multiple valves, each pump likely includes several chambers, and, as noted above, each frac application is serviced by perhaps ten to twenty pumps overall. This means that the opportunity for a given valve to fail when there may be 50 to 200 valves or more in operation is quite significant. Once more, once one valve or pump begins to fail or operate inefficiently, the effect may cascade by placing added strain on other pumps in order to operate at the same level of application output.

Manual inspection of valves at regular intervals may be time consuming and hazardous for operators. Once more, the cost of taking pumps offline for inspection may be exorbitant. Thus, efforts have been undertaken to monitor valve conditions through more remote measures. For example, acoustic monitoring techniques have been developed which may be helpful in acquiring valve inefficiency information. However, these techniques are often complex and highly inaccurate due to the tremendous number of variables involved in deciphering acoustic readings. For example, pressure, fluid components, noise and other variables may change from application to application, with each providing different forms of acoustic information which may or may not be indicative of valve and seal conditions, depending on application parameters.

As a result of present predictive limitations, it remains most likely that operators will generate a protocol for pump use largely based on empirical models that are focused on predicting usable valve life. Specifically, a given pump and valve setup may be rated for use in certain conditions for certain periods, after which, the pump will be taken off line and replaced on a fixed schedule. Unfortunately, this means that on average, pumps are generally taken offline 30-40% earlier than is actually required in order to avoid inefficiencies or catastrophic failure. Not only does this waste otherwise useful pump life, it also fails to predict circumstances in which a pump might prematurely fail at an even earlier time without any real-time warning. Over the course of operations, this means that potentially millions of dollars are lost in time spent on premature pump replacement and unanticipated pump failures.

SUMMARY

A valve condition monitoring system for a pump. The pump includes a fluid end and a power end defining a chamber therebetween. At least one valve governs a fluid flow from the fluid end. A suction pressure sensor is provided to monitor fluid pressure flowing to the fluid end. By the same token, a discharge pressure sensor is also provided to monitor fluid pressure flowing from the fluid end. Further, an encoder is provided to monitor reciprocation of the valve via a power end shaft. Acquisition hardware and software are provided to obtain data from each of the sensor and the encoder for establishing a substantially real-time condition of the valve.

DETAILED DESCRIPTION

Embodiments are described with reference to certain oilfield fracturing operations. In the examples provided, stimulation operations applied to a well which include fracturing through the aid of a variety of positive displacement pumps are illustrated. For these types of operations, pump valve efficiency and potential failure may be of substantial concern. Thus, embodiments of a valve condition monitoring system are detailed herein. However, such a system may be of benefit to any number of other operations, whether or not multiple pumps are utilized and whether or not the environment is that of the oilfield. So long as a system is provided that includes pressure sensors at each of fluid intake and fluid discharge ends relative a chamber defined by a valve, in combination with an encoder and acquisition hardware, appreciable benefit may be realized as detailed further below.

Figure 1:
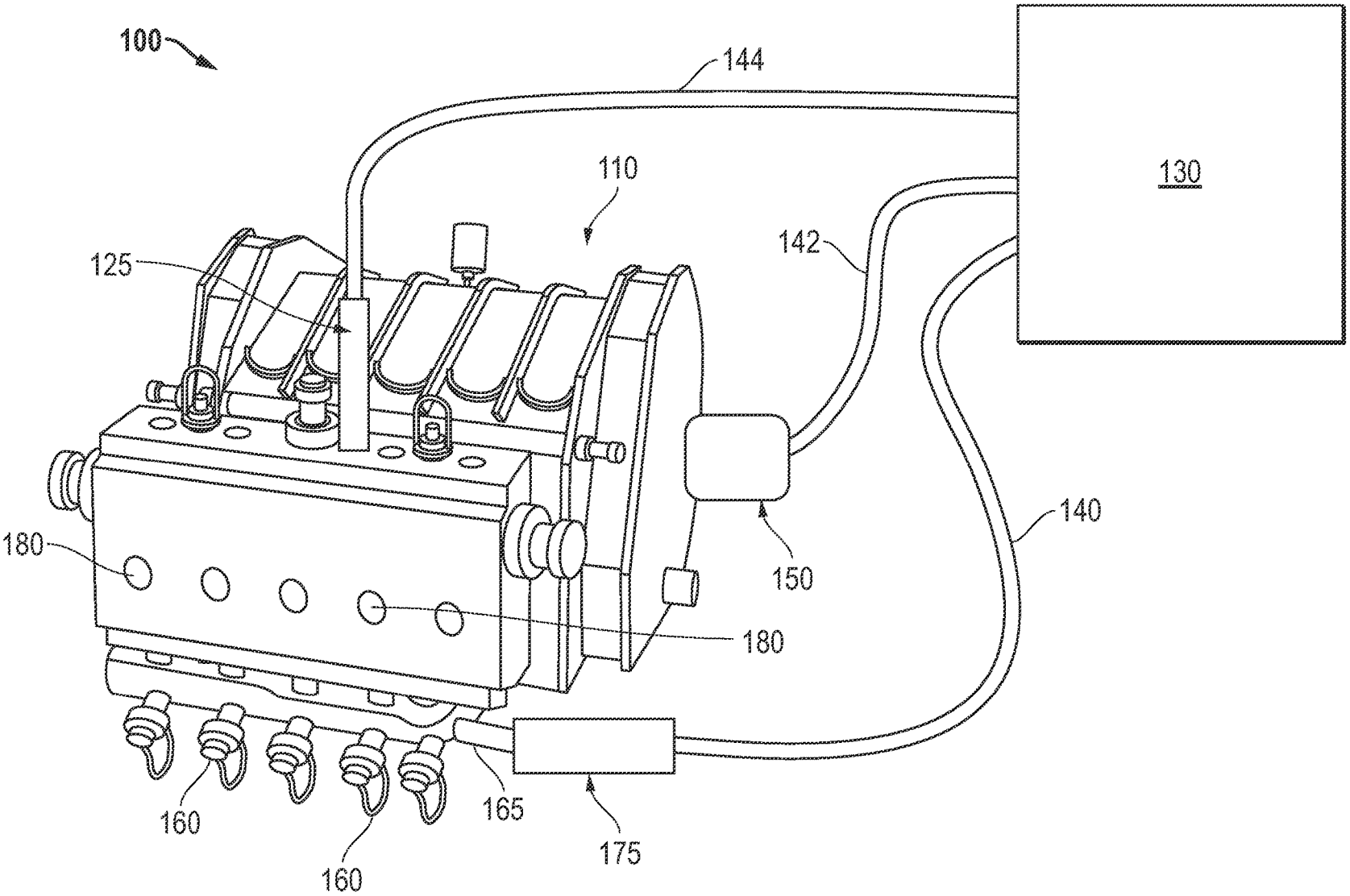
FIG. 1 is a perspective view of an embodiment of a valve condition monitoring system incorporated into a positive displacement pump.
Figure 3:
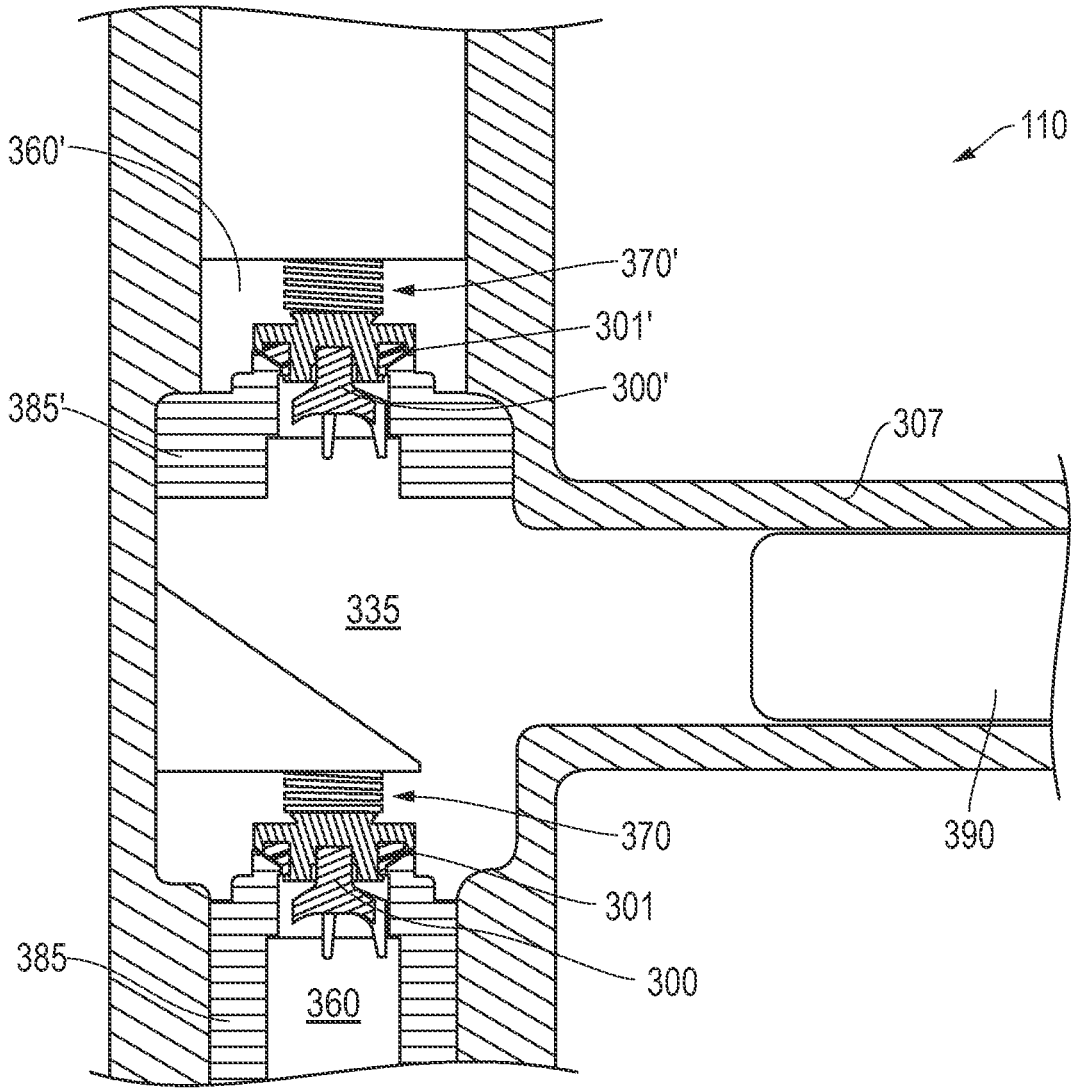
FIG. 3 is a side cross-sectional view of a chamber region of the pump of FIG. 1 from which an embodiment of valve condition monitoring may be applied.

Referring now to FIG. 1, a perspective view of an embodiment of a valve condition monitoring system 100 is illustrated. For the embodiment shown, the system 100 is utilized in conjunction with a positive displacement pump 110 in order to predict health of a valve such as 300 or 300' as illustrated in FIG. 3. More specifically, an acquisition system 130 of suitable hardware and software is utilized to acquire and interpret pump data. This pump data is acquired from various sources that include intake pressure from an intake pressure sensor 175, discharge pressure from a discharge pressure sensor 125 and position data from an encoder 150. The pressure sensors 125, 175 may be connected to the pump 110 to acquire real-time pressure at high-speed acquisition rates, whereas the encoder 150 may be coupled to the power-end drive of the pump 110 and a high speed digital module thereof. In the embodiment shown, the acquisition system 130 acquires the noted analog or digital data through various communication lines 140, 142, 144 and over a CAN bus. Of course, other forms of data acquisition, including wireless transmission may be utilized. However, for the embodiment illustrated, efficiency advantages may be realized in the use of off-the-shelf, commonly utilized sensor and encoder configurations.

Figure 2:
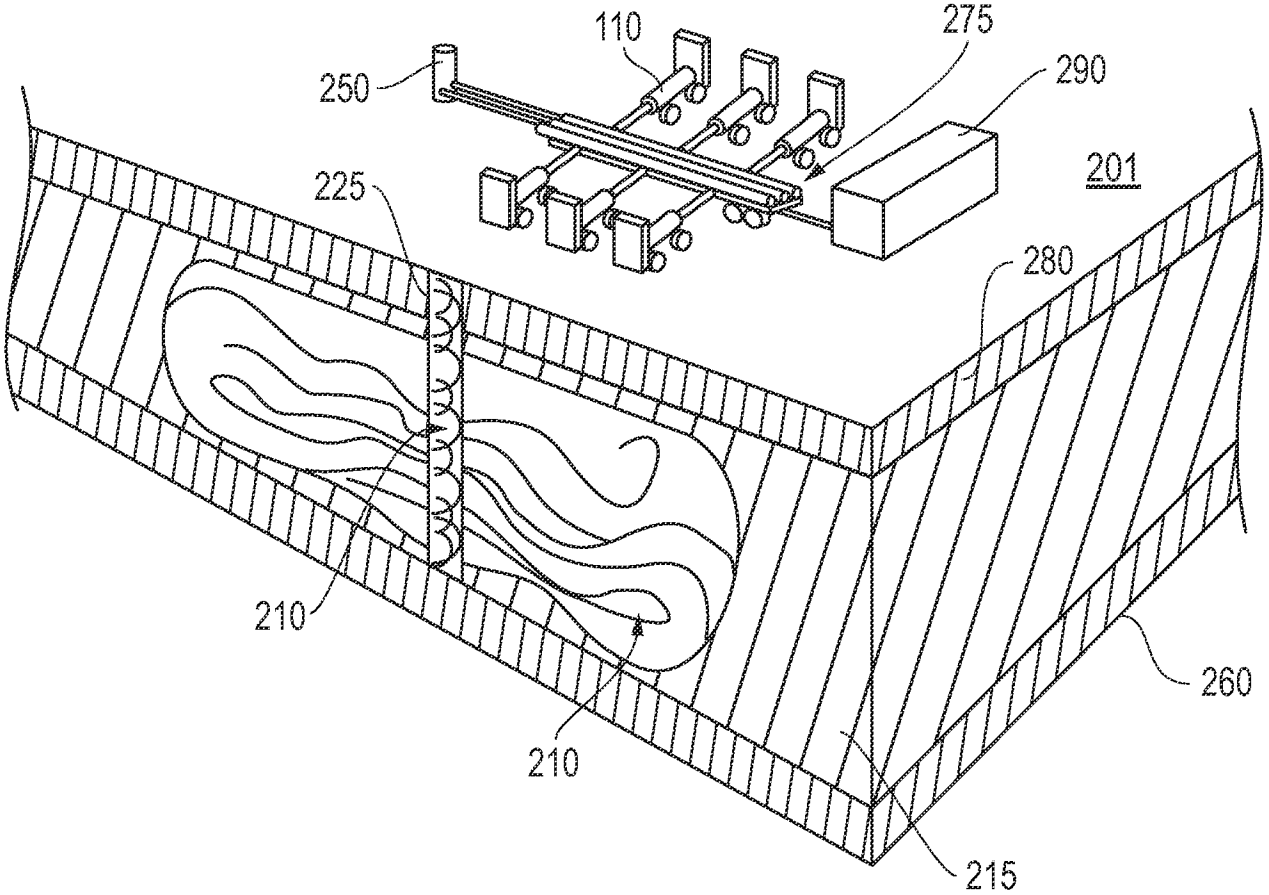
FIG. 2 is an overview of an oilfield where a host of pumps and systems such as that of FIG. 1 are utilized in fracturing operations.

Continuing with reference to FIG. 1, the pump 110 is a quintiplex positive displacement pump with five different intake port 160 and isolated chamber 180 locations. Of course, the overall system 100 may be applied to triplex, single chamber or any other numbered chamber type of positive displacement pump. Regardless, the fluid end of the pump 110 is configured such that each chamber is configured to draw in fluid through a common line 165 and ultimately discharge the fluid at a high pressure for contribution to a fracturing application as illustrated at FIG. 2. For each chamber this means that a reciprocating plunger 390 and valves 300, 300' move in a synchronized manner for the sake of drawing in, pressurizing and discharging a fracturing fluid for the fracturing application (again, see FIG. 3).

While the described moving components may be directed to move at a given rate, the actual rate of speed may slightly vary from cycle to cycle (or rotation to rotation). Thus, the encoder 150 may be utilized to acquire actual position data of these moving components in real-time. Indeed, even for a pump 110 with five or more separate chambers 180, a single encoder 150 may be utilized to keep real-time track of component position for each chamber 180. This is because the movement of every component in every chamber 180 is effectuated by the same drive shaft of the pump 110. That is, component positions in one chamber 180 will be directly related to component positions in each of the other chambers 180 due to a shared drive system. Thus, while the acquisition system 130 may be acquiring combined position data from each chamber 180 simultaneously, a processor thereof may be utilized to decipher the data chamber 180 by chamber 180. Of course, as a general rule, once a pump 110 is taken off-line, the entire fluid end is generally removed in addressing repair issues. Therefore, storing or tracking such detailed chamber specific information may be unnecessary.

Referring now to FIG. 2, an overview of an oilfield 201 is depicted where a host of pumps 110 and systems 100 such as that of FIG. 1 are utilized in fracturing operations. Each pump 110 incorporates embodiments of valves 300, 300' and seals 301, 301' as shown in FIG. 3. Together, the pumps 110, along with other equipment illustrated, are part of an overall hydraulic fracturing system. The pumps 110 may operate at between about 700 and about 2,000 hydraulic horse power to propel an abrasive fluid 210 into a well 225. The oilfield 201 includes various formation layers 215, 260, 280 where fracturable rock 215 is targeted for hydrocarbon recovery. The abrasive fluid 210 contains a proppant such as sand, ceramic material or bauxite for disbursing beyond the well 225 and into the fracturable rock 215 for the promotion of hydrocarbon recovery therefrom. Chemical additives may also be included.

With added reference to FIG. 3, in addition to the pumps 110, other equipment may be directly or indirectly coupled to the well head 250 for the operation. This may include a manifold 275 for fluid communication between the pumps 110. A blender 290 and other equipment may also be present. In total, for such a hydraulic fracturing operation, each pump 110 may generate pressure of between about 2,000 and about 15,000 PSI or more. Thus, as valves 300, 300' strike seats 385, 385' within each pump 110 an extreme amount of stress is concentrated at each valve-seat interface as described (see FIG. 3). Nevertheless, with added reference to FIG. 1, the deterioration of the valves 300, 300', seals 301, 301', seats 385, 385' or any other internal architecture having an impact on pump efficiency may be detected and relayed to operators in real-time via the described monitoring system 100. As a result, pump life may be extended beyond a fixed schedule where pump function has not been compromised. By the same token, in circumstances where premature failure begins to emerge, a pump 110 may be taken off-line prior to any catastrophic event. Thus, damage to the pump 110 may be avoided along with added strain on adjacent pumps supporting the fracturing operations.

Referring now to FIG. 3, a side cross-sectional view of the pump 110 of FIG. 1 is illustrated for which an embodiment of a valve condition monitoring system 100 may be applied. The pump 110 employs lower 300 and upper 300' valves as shown. Each valve 300, 300' is outfitted with an embodiment of a seal 301, 301'. The monitoring system 100 of FIG. 1 may be employed to substantially account for actual seal life during regular pump use at an oilfield during conventional operations such as fracturing or other stimulation operations. While seals 301, 301' may be the most commonly susceptible components to regular wear, the system 100 of FIG. 1 may be utilized to provide indicators of pump inefficiencies due to any type of pump component wear.

As alluded to above, regular use of a pump 110 in oilfield operations means the repeated reciprocation of valves 300, 300' against a seat 385, 385' for an extended duration, perhaps weeks at a time. This takes place as a plunger 390 reciprocates within a housing 307 toward and away from a chamber 335. In this manner, the plunger 390 effects high and low pressures on the chamber 335. For example, as the plunger 390 is thrust toward the chamber 335, the pressure within the chamber 335 is increased. At some point, the pressure increase will be enough to effect an opening of the upper discharge valve 300' to allow release of fluid and pressure from within the chamber 335. The amount of pressure required to open the valve 300' as described may be determined by a discharge mechanism 370 such as a spring which keeps the discharge valve 300' in a closed position (as shown) until the requisite pressure is achieved in the chamber 335. In an embodiment where the pump 110 is employed with others for fracturing at an oilfield, 201, pressures in excess of 2,000-15,000 PSI may be achieved in this manner (see FIG. 2).

Continuing with reference to FIG. 3, the plunger 390 also effects a low pressure on the chamber 335 as it retreats away from the chamber 335, thus decreasing the pressure therein. As this occurs, the discharge valve 300' will strike closed against the upper discharge valve seat 385'. This movement of the plunger 390 away from the chamber 335 will initially result in a sealing off of the chamber 335. However, as the plunger 390 continues to move away from the chamber 335, the pressure therein will continue to drop, and eventually a low or negative differential pressure will be achieved therein. Eventually, the pressure decrease will be enough to effect an opening of the lower intake valve 300 for the uptake of fluid into the chamber 335. Again, the amount of negative or reduced pressure required to open the valve 300 may be predetermined by an intake mechanism 370 such as a spring. Of course, upon return of the plunger 390 toward the chamber 335, the lower valve 300 will again strike closed against the lower valve seat 385 with a seal achieved by the lower seal 301.

The repeated striking of the valves 100, 100' and seals 301, 301' against the metal seats 385, 385' subjects, particularly the elastomeric seals 301, 301', to a significant amount of potentially wearing conditions. However, as alluded to above, any number of pump component issues may arise that might affect pump performance. Regardless, the system 100 of FIG. 1 may be utilized to detect any pump condition that might be indicative of a pump inefficiency in pumping effectiveness. This not only allows for real-time determination of such emerging issues but also allows for the continued use of the pump 110 in absence of any issues beginning to present. So, by way of example only, a pump 110 that is beginning to display signs of inefficiency via pressure monitoring, may be pulled offline well in advance of expected changeout. By the same token, a pump 110 that is not showing any signs of emerging inefficiencies may be kept online even if substantially exceeding its expected life. In either case, substantial time and cost savings may be realized. More specific examples of such circumstances are detailed hereinbelow.

Figure 4A:
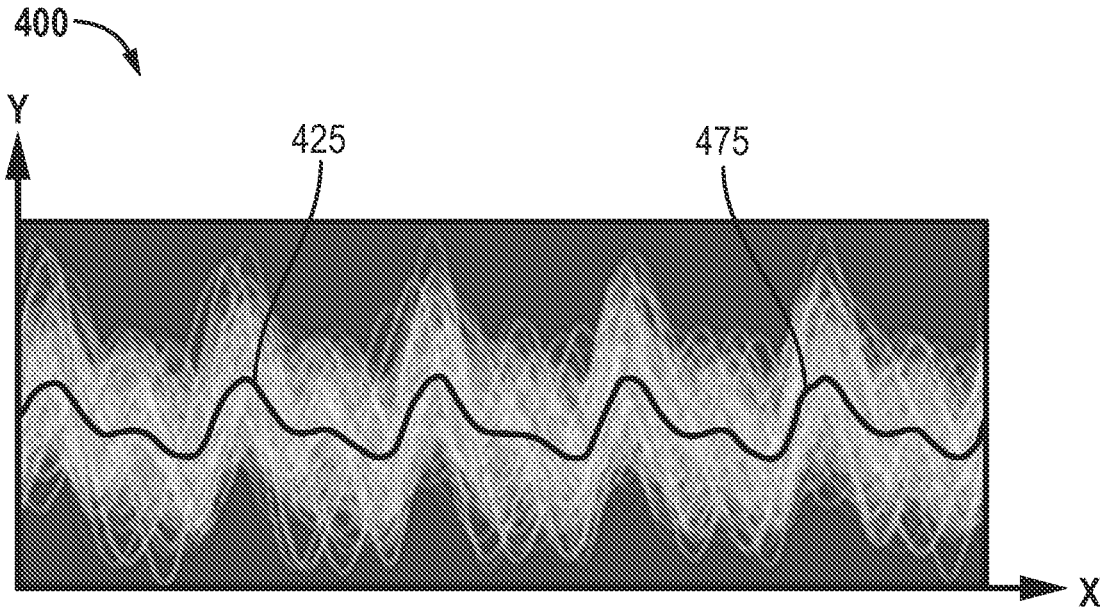
FIG. 4A is a chart illustrating data obtained from the valve of FIG. 3 in absence of valve inefficiency issues.

Referring now to FIG. 4A, a chart is shown illustrating data obtained from the valve of FIG. 3 in absence of valve inefficiency issues. So, for example, a repeating pattern of peaks 425, 475 is shown that correspond to repeated and proper valve striking. For this chart and those which follow, pressure values along the y-axis are plotted against time along the x-axis. With added reference to FIG. 1, the data utilized to generate the chart is obtained from the monitoring system 100. More particularly, the data is in turn, presented through the use of algorithms stored at the acquisition system 130 which are applied to the pressure sensor 125, 175 and encoder 150 attained data in real-time. This data may be attained at between about 250 and 750 HZ which is parsed and presented for every revolution or cycling at the fluid end of the pump 110 (i.e. for each completed reciprocation of the plunger 390, for example).

In one embodiment, data analysis is performed continuously over every 100-200 revolutions and utilized in a round robin fashion wherein old revolution data sets are removed and replaced as new data sets are attained. As described further below with reference to FIGS. 5A and 5B, this may allow for a robust failure prediction criterion that utilizes machine learning, pattern classification and adaptive algorithms to be applied to various equipment and field conditions. Thus, filtering of extraneous data, even from other pumps, may also take place (e.g. by performing ensemble averages of wave forms). Ultimately, individual plunger-based response signals may be utilized to determine the quality of pumping that is attained from the valves 301, 301'.

Figure 4B:
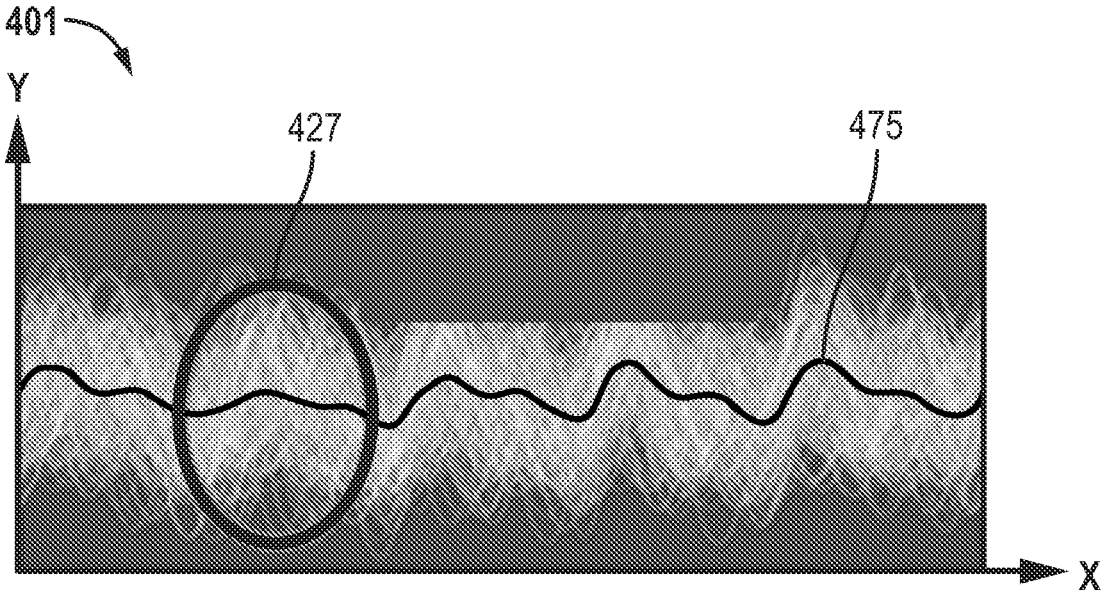
FIG. 4B is a chart illustrating data obtained from the valve of FIG. 3 as valve inefficiency issues are presented.

Referring now to FIG. 4B, again with added reference to FIGS. 1 and 3, a chart is shown illustrating data obtained from the pump 110 as valve inefficiency issues are presented. That is, the charts of FIGS. 4A and 4B each display waveforms of valve opening and closing crests and troughs. As illustrated, the data may be interpolated to align with encoder 150 revolution counts as noted above. In these illustrations, a more discrete central unitary waveform is even presented as a matter of user-friendliness for sake of presentation here. That is, even though pump speed may slightly increase or decrease over time, up-sampling and interpolation of encoder counts may be utilized to provide more readable data illustration for sake of operator analysis. Regardless, it is apparent that a missing waveform region 427 is now presented where a peak 425 should be, when compared to the chart of FIG. 4A. However, other peaks such as that at 475 remain. Thus, this may be an indicator of an inefficient stroking or output from the pump 110. Regardless of whether this is due to the lower 301 or upper 301 valve or other pump components, it is an indicator that it may be of benefit to remove the pump 110 from the oilfield 201 of FIG. 2, for example. Of course, more pre-emptive indicators of pump inefficiency may be of added value as described below.

Figure 5A:
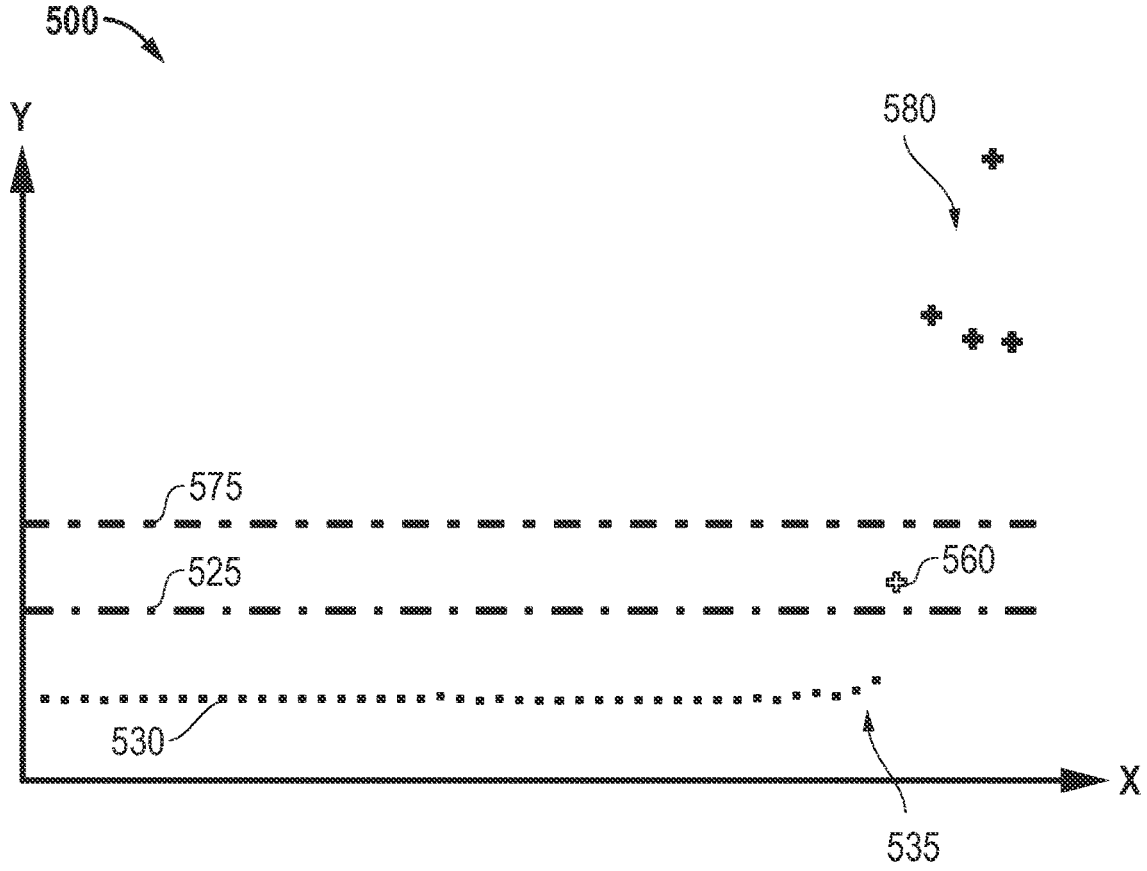
FIG. 5A is a chart illustrating data obtained from an embodiment of a valve condition monitoring system from which premature pump failure is detected.
Figure 5B:
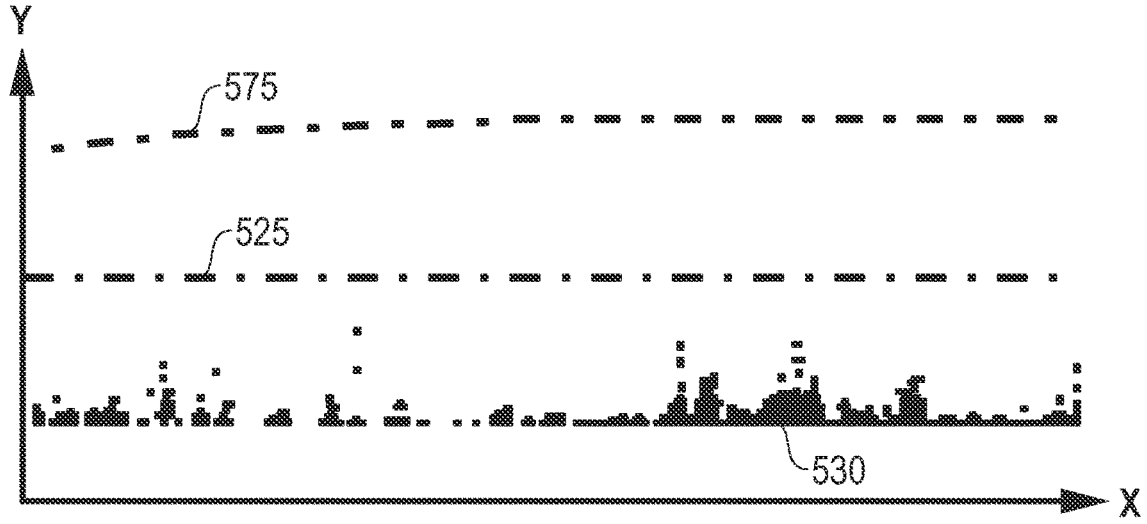
FIG. 5B is a chart illustrating data obtained from an embodiment of a valve condition monitoring system from which pump efficiency is demonstrated beyond the predicted life of the valve.

Referring now to FIG. 5A, a chart is shown illustrating data obtained from an embodiment of a valve condition monitoring system from which premature pump failure is detected. In the case of FIGS. 5A and 5B, the y-axis is not a direct pressure, but a pressure deviation from expected result data that is prestored at the acquisition system 130 of FIG. 1. A predetermined warning threshold 525 is also established and stored at the acquisition system 130, below which a deviation may be tolerated. However, pressure deviation data which begins to rise 535 may be of concern. So, for example, a warning may be presented to operators upon repeated detections above the warning threshold 525. Further, an automatic shutdown protocol may be applied to the pump 110 once the data crosses the catastrophic threshold 575 as indicated at 560. For example, in one embodiment, automatic shutdown is initiated once multiple sequential detections crossing the threshold 575 are detected. In this way, catastrophic data detections (e.g. at 580) may be used to halt potentially catastrophic effects on the pump 110 and overall operations.

With added reference to FIGS. 1 and 3, the real-time detection of rising deviation data 535 illustrated in FIG. 5A may be of substantial benefit, particularly where the pump 110 has been in operation for less than an expected period of time before replacement. For example, improper valve installation, unplanned particle presentation and other issues may arise that lead to what would be considered premature valve or pump failure. For conventional operations there may be no adequate warning of such events in advance. However, where the system 100 of FIG. 1 is applied, an indicator of potential inefficiencies may be presented in real-time so as to prevent a catastrophic event even where the pump may have been in operation for only a short period of time. Thus, operation efficiency may be kept at an optimum and high cost fluid-end damage may be avoided.

In contrast to the chart of FIG. 5A, the chart of FIG. 5B illustrates deviation data obtained from an embodiment of a valve condition monitoring system from which pump efficiency is demonstrated beyond the predicted life of the valve. For example, it is entirely possible that the pump 110 may function at a near optimum level well beyond an expected period based on known operation conditions. That is, for both charts deviation data 530 is presented. However, for the chart of FIG. 5B, this data 530 never traverses either predetermined threshold 525, 575. Stated another way, it is entirely possible that after 150% of expected pump life, the pump 110 may continue to operate optimally without any sign of inefficiency. Where this is the case, pulling the pump offline as a matter of course would only increase downtime and present potential unnecessary hazards to operators. Thus, such costs may be avoided.

A variety of different criteria may be established to further optimize the system 100. For example, it may be that data crossing the predetermined warning threshold 525 may trigger a warning to operators once crossed but only lead to automatic shutdown once a predetermined number of consecutive data points are presented which all cross the catastrophic threshold 575. Such tolerances and limits may be established on a case by case basis depending on overall operations criterion.

Figure 6:
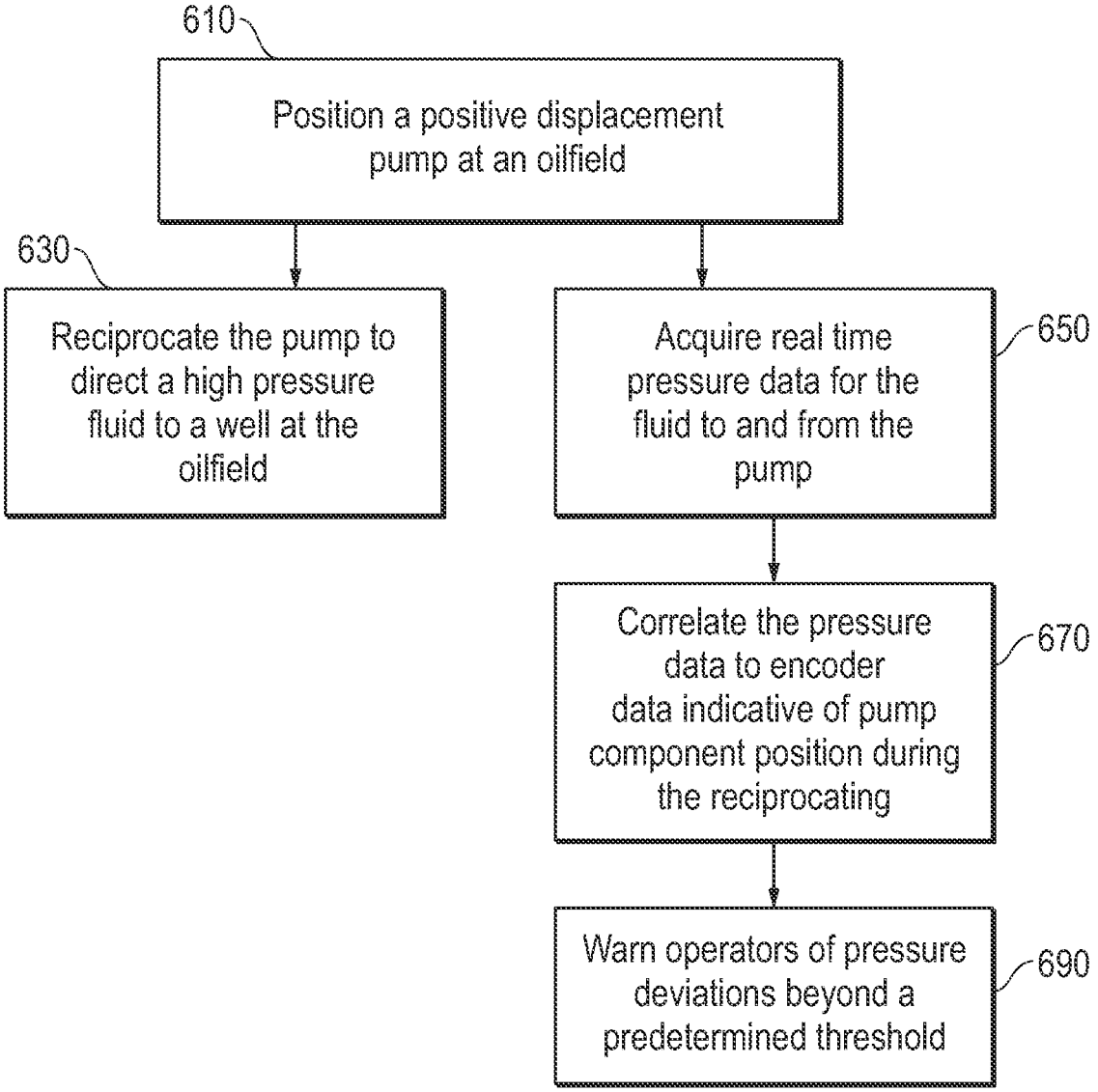
FIG. 6 is a flow-chart summarizing an embodiment of employing a valve condition monitoring system.

Referring now to FIG. 6, a flow-chart is presented summarizing an embodiment of employing a valve condition monitoring system. Namely, a positive displacement pump is positioned at an oilfield and put to use, for example to introduce a high pressure abrasive fluid to a well (see 610, 630). As this occurs, an acquisition unit of the system may be used to acquire real-time pressure data for fluid directed to and from the pump as indicated at 650. As noted at 670, this data may be correlated to data from an encoder which is indicative of pump component position during use of the pump. With this capability, operators may be warned of deviations from expected pressure readings so as to warn operators of any substantial deviations (see 690). Thus, premature issues with pump operations may be detected while at the same time allowing for pump life extension where such issues are not detected.

Embodiments described hereinabove include techniques for monitoring real-time pump conditions where abrasive fluids are pumped at pressures that may exceed several thousand PSI. Whether or not issues present at valve seals, other pump components or not at all may be determined in real-time. Thus, pump efficiency for multi-pump operations may be enhanced by removing a prematurely inefficient pump or by keeping a pump in place for longer than the pump's life expectancy. Either way, added efficiency is provided and strain on other pumps due to an ineffective pump is kept to a minimum.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A monitoring system for a positive displacement pump, the system comprising:

an intake pressure sensor to monitor an intake pressure of a fluid flowing into a fluid end of a pump to a chamber having at least one valve for directing a flow of the fluid into or from the fluid end;

a discharge pressure sensor to monitor a discharge pressure of the fluid as the fluid flows from the fluid end;

an encoder to monitor pump component positions; and an acquisition system to obtain data from each of the sensors and the encoder for establishing a substantially real-time condition of the pump by causing a plurality of operations to be conducted, the operations comprising:

utilizing the intake pressure sensor to acquire intake pressure data of the fluid as the fluid flows into the fluid end;

utilizing the discharge pressure sensor to acquire discharge pressure data of the fluid as the fluid flows from the fluid end;

utilizing the encoder to acquire position information of the pump component;

correlating the intake pressure data and the discharge pressure data with the position information;

determining magnitudes of deviations of the intake pressure data and the discharge pressure data from expected values of the intake pressure and the discharge pressure, respectively; and comparing the magnitudes of the deviations to one or more deviation thresholds.

2. The monitoring system of claim 1 wherein the condition of the pump is reflective of a condition of one of the at least one valve, a seal at the at least one valve, a seat for the at least one valve or a reciprocating plunger of the pump.

3. The monitoring system of claim 1 wherein the pump includes multiple chambers and the fluid end is coupled to a common line supplying the fluid to each of the chambers.

4. The monitoring system of claim 3 wherein the fluid flows from the fluid end to a common discharge manifold shared by at least another pump.

5. The monitoring system of claim 3 wherein the pump is one of a triplex pump and a quintuplex pump for use at an oilfield.

6. The monitoring system of claim 5 wherein the acquisition system includes a display for real-time presentation of pump condition information to an operator at the oilfield.

7. A method of monitoring a condition of a positive displacement pump, the method comprising:

supplying a fluid to a chamber at a fluid end of a pump;

utilizing an intake pressure sensor to acquire intake pressure data of the fluid;

pressurizing the fluid in the chamber, and discharging the fluid from the fluid end;

utilizing a discharge pressure sensor to acquire discharge pressure data of the fluid being discharged from the fluid end;

utilizing an encoder to acquire position information from moving internal components of the pump during the supplying of the fluid to the chamber, the pressurizing of the fluid, and the discharging of the fluid from the fluid end;

correlating the intake pressure data and the discharge pressure data with the position information;

determining magnitudes of deviations of the intake pressure data and the discharge pressure data from expected values of the intake pressure and the discharge pressure, respectively; and comparing the magnitudes of the deviations to one or more deviation thresholds.

8. The method of claim 7 wherein the moving internal components are selected from a group consisting of a valve, another valve and valve seats.

9. The method of claim 7 wherein the pump is positioned at an oilfield and the fluid is an abrasive fluid, the method further comprising supplying the fluid to a well for stimulation.

10. The method of claim 9 wherein the abrasive fluid includes proppant and the stimulation includes fracturing of the well.

11. The method of claim 10 wherein the fluid is delivered to the well at between about 2,000 PSI and about 15,000 PSI.

12. The method of claim 7 further comprising presenting a warning to an operator of pump inefficiency upon determining one of the magnitudes of the deviations exceeds a warning threshold of the one or more deviation thresholds.

13. The method of claim 7 further comprising initiating an automated shutdown of the pump upon determining one of the magnitudes of the deviations exceeds a catastrophic threshold of the one or more deviation thresholds.

14. The method of claim 7 further comprising employing continuous use of the pump beyond a predetermined life expectancy in absence of determining any one of the magnitudes of the deviations exceeds a threshold of the one or more deviation thresholds.

15. The method of claim 7 further comprising terminating use of the pump prior to a predetermined life expectancy upon determining one of the magnitudes of the deviations exceeds a threshold of the one or more deviation thresholds.

16. A positive displacement pump assembly for operating at an oilfield and comprising:

a positive displacement pump with a fluid end and a power end defining a chamber therebetween with at least one valve for governing fluid flow therein;

an intake pressure sensor to monitor an intake pressure of a fluid flowing to the chamber;

a discharge pressure sensor to monitor a discharge pressure of the fluid as the fluid flows from the chamber;

an encoder coupled to the positive displacement pump to monitor reciprocation of the at least one valve; and an acquisition system to acquire data from each of the sensors and the encoder for establishing a substantially real-time condition of the positive displacement pump by causing a plurality of operations to be conducted, the operations comprising:

utilizing the intake pressure sensor to acquire intake pressure data of the fluid as the fluid flows to the chamber;

utilizing the discharge pressure sensor to acquire discharge pressure data of the fluid as the fluid flows from the chamber;

utilizing the encoder to acquire position information of the at least one valve;

correlating the intake pressure data and the discharge pressure data with the position information;

determining magnitudes of deviations of the intake pressure data and the discharge pressure data from expected values of the intake pressure and the discharge pressure, respectively; and comparing the magnitudes of the deviations to one or more deviation thresholds.

17. The assembly of claim 16 wherein the chamber is one of a plurality of chambers of the positive displacement pump and wherein the sensors and encoder are configured to monitor each of the chambers of the plurality.

18. The assembly of claim 17 wherein the acquisition system is a single acquisition system to acquire data from each of the sensors and the encoder.

19. The assembly of claim 16 wherein the positive displacement pump is one of a plurality of pumps at the oilfield.

20. The assembly of claim 19 wherein each pump of the plurality of pumps comprises a dedicated acquisition system and contributes to a common manifold line to a well at the oilfield.

* * * * *